US008550739B1

(12) United States Patent
Robbins

(10) Patent No.: US 8,550,739 B1
(45) Date of Patent: Oct. 8, 2013

(54) SHAVING CREAM APPLICATOR BRUSH

(76) Inventor: Timothy M. Robbins, Aliso Viejo, CA (US)

( * ) Notice: Subject to any disclaimer, the term of this patent is extended or adjusted under 35 U.S.C. 154(b) by 54 days.

(21) Appl. No.: 13/415,056

(22) Filed: Mar. 8, 2012

(51) Int. Cl.
*A46B 11/00* (2006.01)

(52) U.S. Cl.
USPC ..... 401/286; 401/45; 401/46; 401/132; 401/133

(58) Field of Classification Search
USPC ..... 401/30, 44–47, 34, 35, 270, 282, 401/286, 288, 132, 133
See application file for complete search history.

(56) References Cited

U.S. PATENT DOCUMENTS 1,763,905 A * 6/1930 Rusell ..... 401/45
2,661,870 A * 12/1953 Huenergardt ..... 222/129
4,797,465 A * 1/1989 Portugall et al. ..... 528/176
D307,216 S 4/1990 Yuen
6,003,523 A 12/1999 Nettlefold
D564,232 S 3/2008 Schulz
D587,778 S 3/2009 Zajk
7,695,207 B1 4/2010 Laghi
2011/0142530 A1 6/2011 Myers

* cited by examiner

*Primary Examiner* — David Walczak

(57) ABSTRACT

A shaving cream applicator brush system has a stationary disk, a rotatable brush body with a plurality of cartridge slots, a tapered stationary cover, and a brush head having bristles. The system has a cartridge that is inserted into the cartridge slot, with a tapered cartridge first end with a cartridge opening and a cartridge membrane that is able to be ruptured on a cartridge tip, a flat cartridge second end, a cylindrical cartridge body, and a cartridge hollow cavity inside. The cartridge has a pressure means to dispose a load of shaving cream from the cartridge through the ruptured cartridge membrane and the cartridge opening. Shaving cream is transported from a cartridge hollow cavity through a cartridge opening, through a stationary disk channel, through a stationary disk tubing extension, into the brush head for use by a user.

7 Claims, 7 Drawing Sheets

SHAVING CREAM APPLICATOR BRUSH

BACKGROUND OF THE INVENTION

Shaving brushes have been used for hundreds of years for applying shaving cream to an area for shaving. Although most shaving brushes resemble a common design, there have been many variations to enhance the effectiveness of the device, visual appeal and prestige associated with its ownership. Some of these variations include the use of exotic animal hair in the brush as well as using ivory, gold, or other exotic materials for the handle. The present invention teaches a novel shaving cream applicator brush that incorporates a unique design and functionality with shaving cream cartridges styled like bullets and a novel appearance of a shaving brush styled like a gun cylinder.

SUMMARY

The present invention features a shaving cream applicator brush system using replaceable cartridges having a general form of a bullet for applying shaving cream through a brush to a user for shaving.

In some embodiments, the system comprises a stationary disk. In some embodiments, the system comprises a brush body located next to the stationary disk. In some embodiments, the brush body is able to be rotated and comprises a plurality of cartridge slots. In some embodiments, the system comprises a tapered stationary cover located on the brush body second end. In some embodiments, the stationary cover comprises a loading recess with loading cap that provides access to the cartridge slot. In some embodiments, the system comprises a brush head comprising bristles.

In some embodiments, the system comprises a cartridge having a tapered cartridge first end comprising a cartridge opening and a cartridge membrane that is able to be ruptured on a cartridge tip, a generally flat cartridge second end, a generally cylindrical cartridge body, and a cartridge hollow cavity located inside. In some embodiments, the cartridge comprises a pressure means to propel a load of shaving cream from the cartridge through the cartridge membrane through the cartridge opening.

In some embodiments, the stationary disk comprises a stationary disk channel and a stationary disk tubing extension that projects out and away from the stationary disk into the brush head. In some embodiments, the cartridge tip seals against an o-ring seal on the stationary disk. In some embodiments, shaving cream is transported from the cartridge hollow cavity through the cartridge opening, through the stationary disk channel, through the stationary disk tubing extension, into the brush head for use by a user.

In some embodiments, a fastening rod is located through the central cross-section of the stationary cover, the brush body, and the stationary disk.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

| | |
|---|---|
| 100 | Shaving cream applicator brush system |
| 110 | Shaving cream |
| 200 | Stationary disk |
| 210 | Stationary disk first side |
| 220 | Stationary disk second side |
| 230 | Stationary disk central axis |
| 240 | Stationary disk channel |
| 250 | Stationary disk tubing extension |
| 260 | O-ring seal |
| 300 | Brush body |
| 310 | Brush body first end |
| 320 | Brush body second end |
| 330 | Brush body central axis |
| 340 | Cartridge slot |
| 400 | Stationary cover |
| 410 | Stationary cover first end |
| 420 | Stationary cover second end |
| 430 | Stationary cover central axis |
| 440 | Loading recess |
| 450 | Loading cap |
| 500 | Brush head |
| 510 | Bristles |
| 600 | Cartridge |
| 610 | Cartridge first end |
| 612 | Cartridge opening |
| 614 | Cartridge membrane |
| 616 | Cartridge tip |
| 620 | Cartridge second end |
| 630 | Cartridge body |
| 640 | Cartridge hollow cavity |
| 650 | Pressure means |
| 652 | Cartridge rotating cap |
| 654 | Cartridge rotating disk |
| 656 | Cartridge threaded shaft |
| 662 | Cartridge pump head |
| 664 | Cartridge check valve |
| 666 | Cartridge spring |
| 668 | Cartridge dip tube |
| 672 | Cartridge actuator |
| 674 | Gasket |
| 700 | Fastening rod |
| 710 | Finger gripping recess |
| 720 | Stationary support member |

Figure 1:
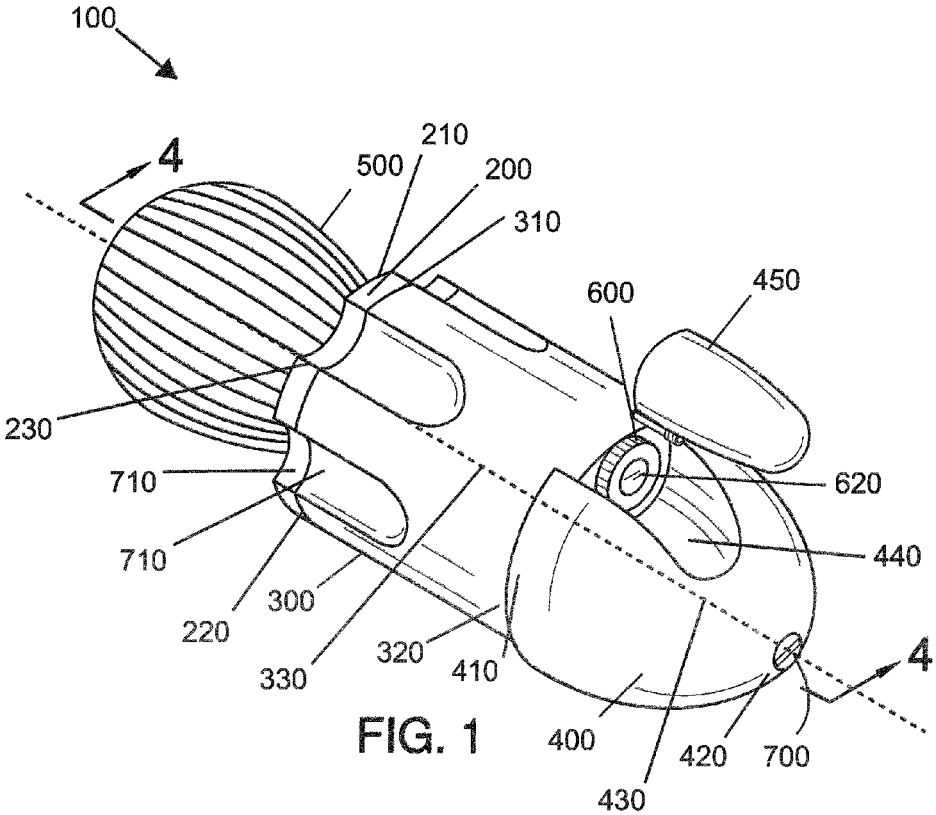
FIG. 1 is a perspective view of the present invention.
Figure 2:
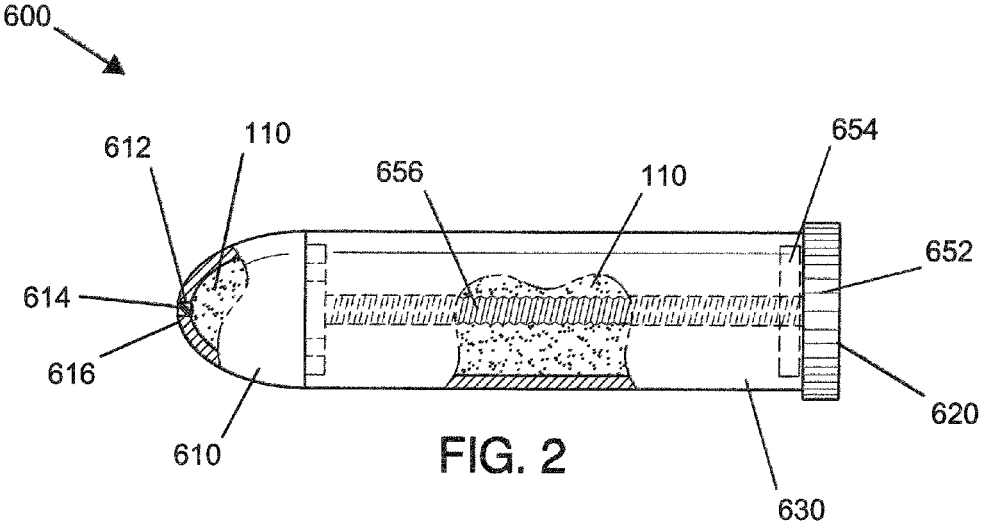
FIG. 2 is a side cross-sectional view of the cartridge of the present invention.
Figure 3:
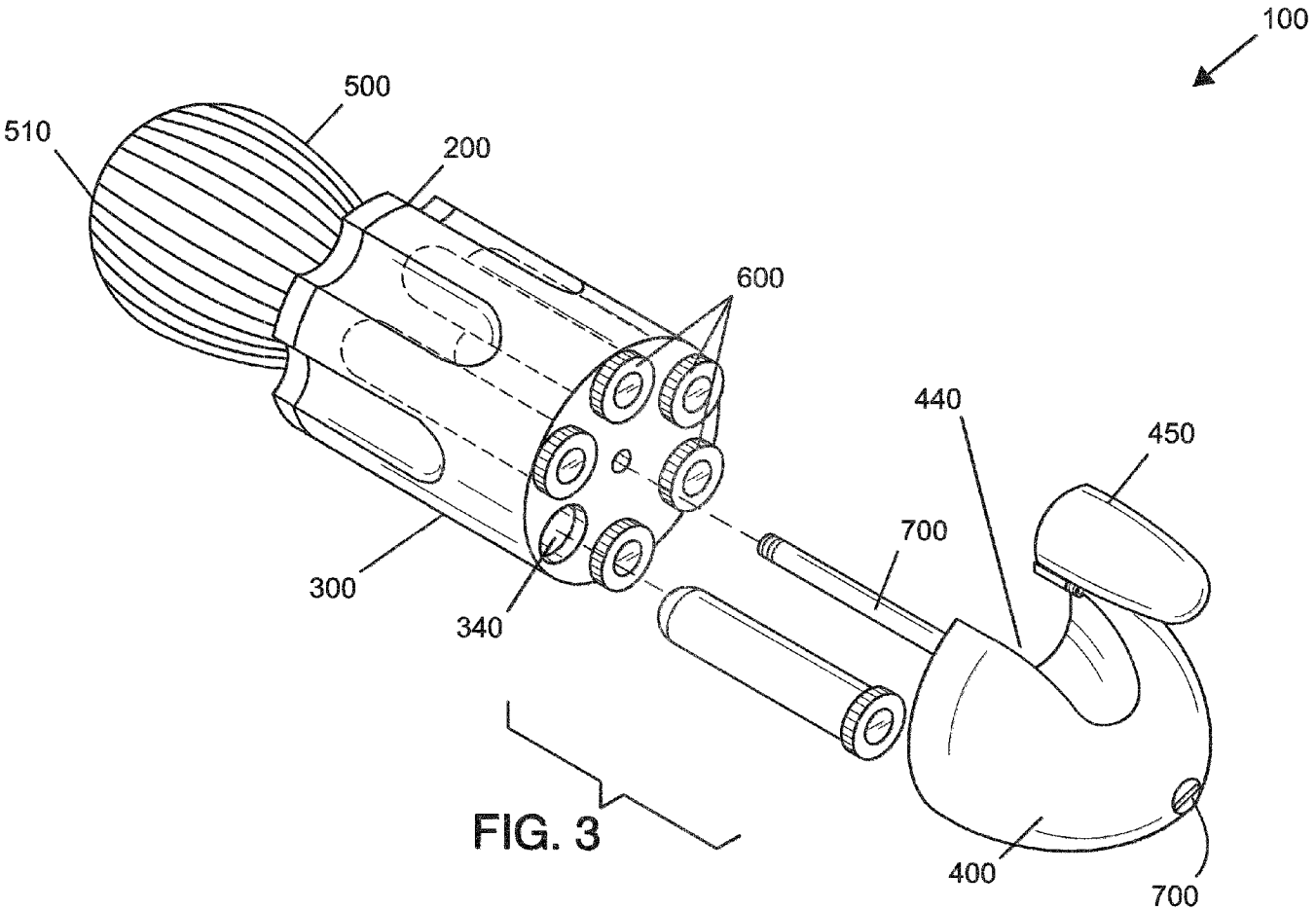
FIG. 3 is a perspective view of the present invention with the stationary cover removed.
Figure 4:
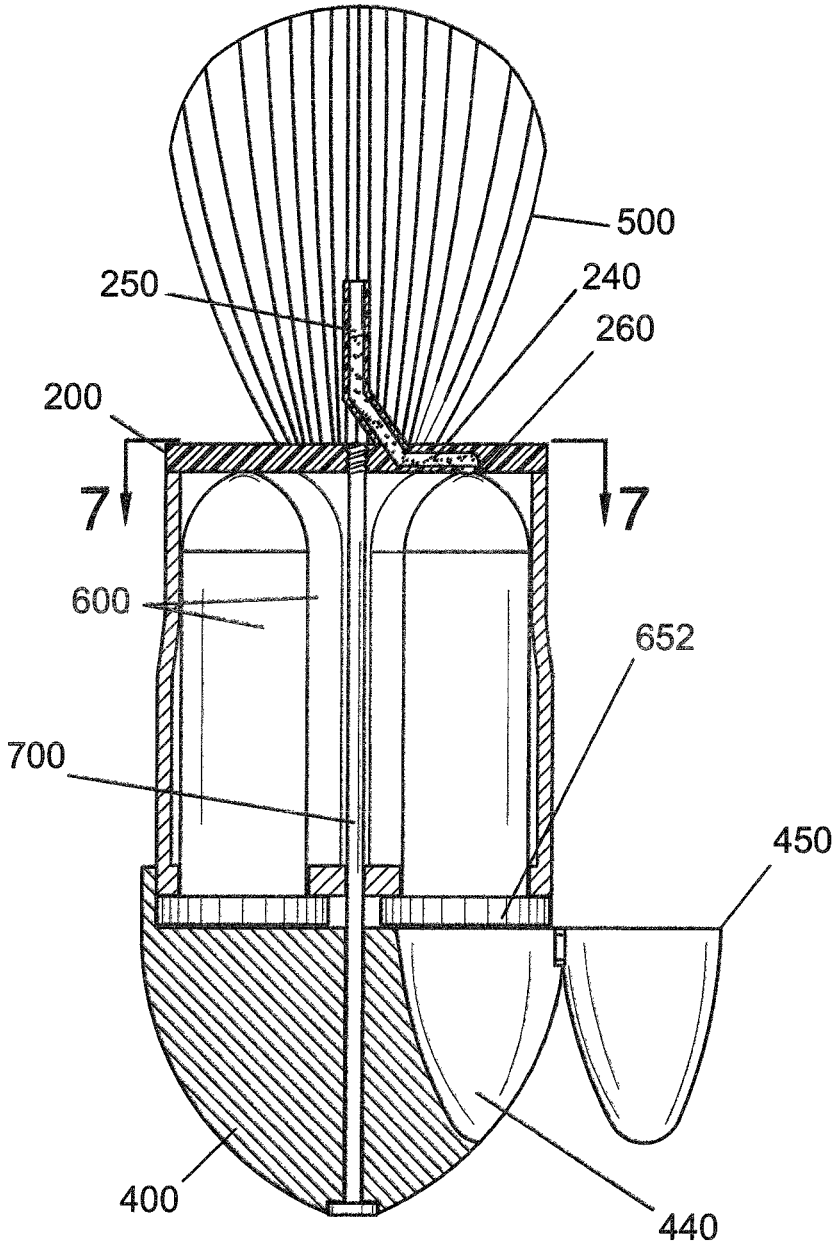
FIG. 4 is a top cross-sectional view of the present invention.
Figure 5:
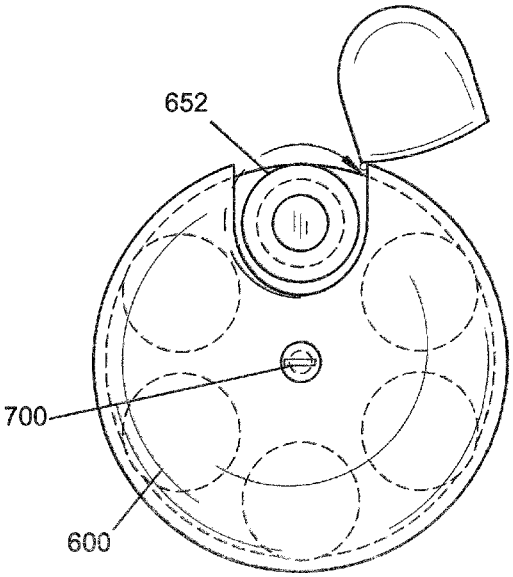
FIG. 5 is a rear view of the present invention.
Figure 6:
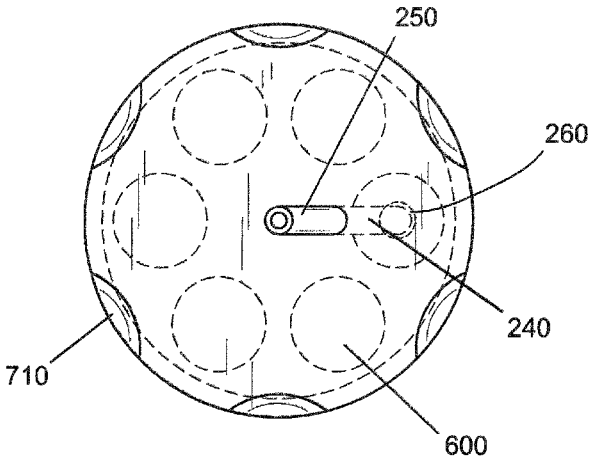
FIG. 6 is a front view of the present invention with the brush head removed.
Figure 7:
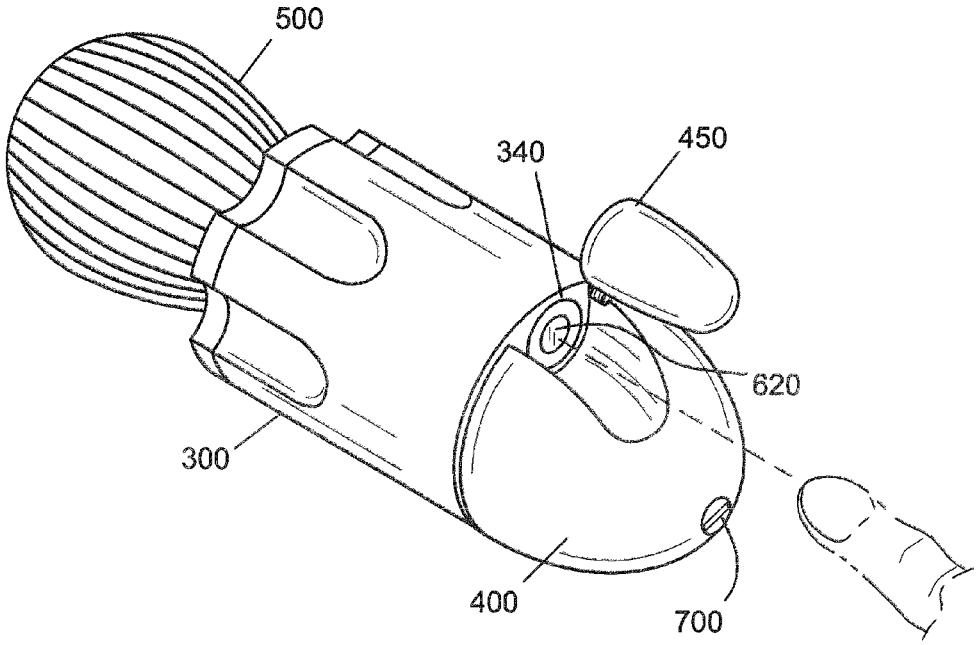
FIG. 7 is a perspective view of the present invention.
Figure 8:
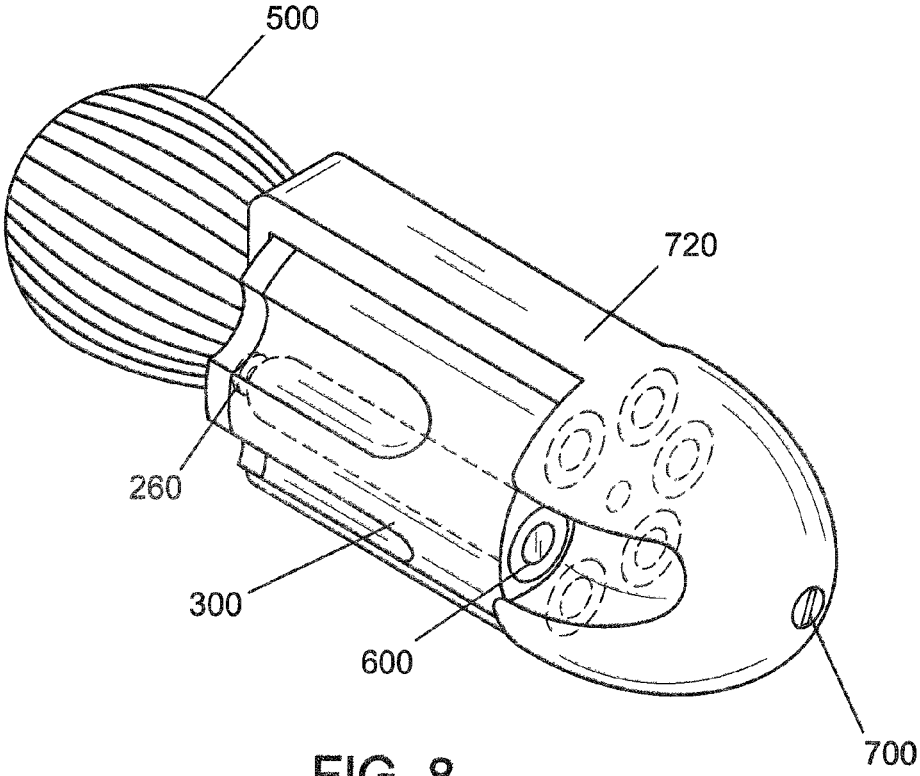
FIG. 8 is a perspective view of an alternate embodiment of the present invention.
Figure 9:
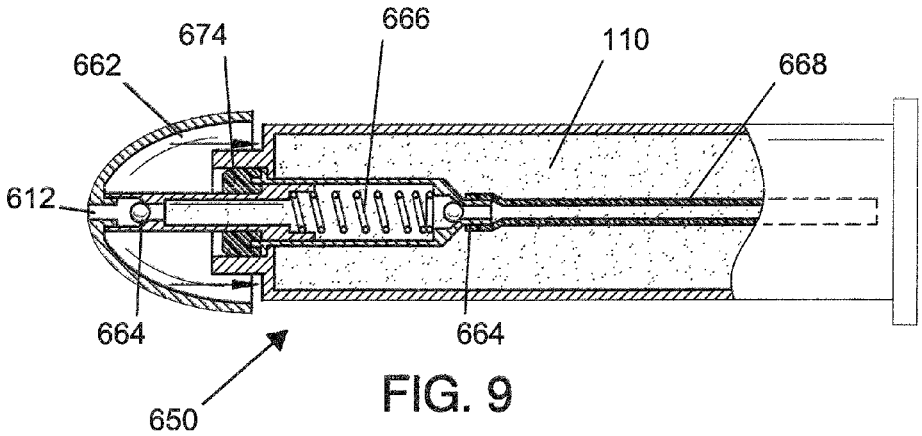
FIG. 9 is a side cross-sectional view of an alternate embodiment of the cartridge of the present invention.
Figure 10:
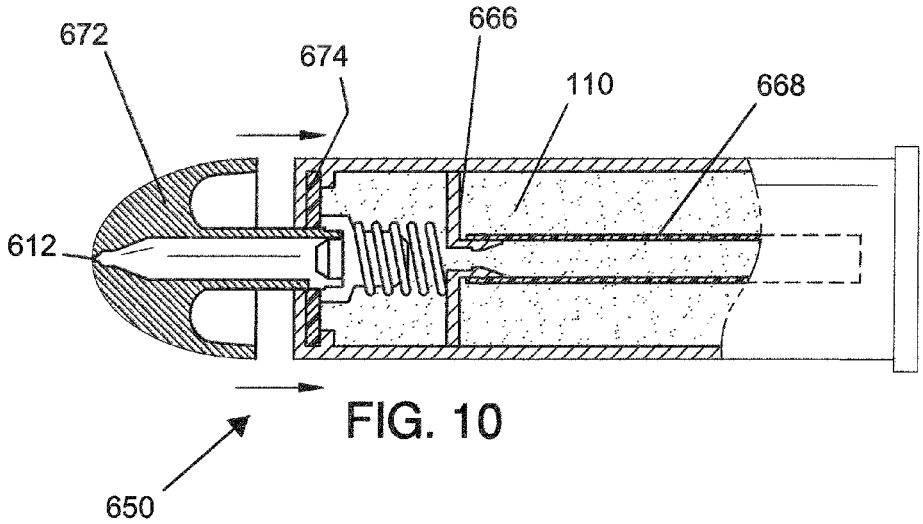
FIG. 10 is a side cross-sectional view of an alternate embodiment of the cartridge of the present invention.

Referring now to FIG. 1-10, the present invention features a shaving cream applicator brush system (100) using replaceable cartridges (600) having a general form of a bullet for applying shaving cream (110) through a brush head (500) to a user for shaving.

In some embodiments, the system (100) comprises a stationary disk (200) with a stationary disk first side (210), a stationary disk second side (220), and a stationary disk central axis (230) located through a central cross-section.

In some embodiments, the system (100) comprises a brush body (300) located on the stationary disk second side (220), with a brush body first end (310), a brush body second end (320), and a brush body central axis (330) located through a central cross-section from the brush body first end (310) to the brush body second end (320). In some embodiments, the brush body central axis (330) is located on the stationary disk central axis (230). In some embodiments, the brush body (300) is rotatable with respect to the brush body central axis (330). In some embodiments, the brush body second end (320) comprises a plurality of cartridge slots (340) located on a radius with respect to the brush body central axis (330).

In some embodiments, the system (100) comprises a tapered stationary cover (400) located on the brush body second end (320), with a stationary cover first end (410), a stationary cover second end (420), and a stationary cover central axis (430) located through a central cross-section. In some embodiments, the stationary cover central axis (430) is located on the stationary disk central axis (230). In some embodiments, the stationary cover (400) further comprises a loading recess (440) with loading cap (450). In some embodiments, the loading recess (440) provides access to the cartridge slot (340).

In some embodiments, the system (100) comprises a brush head (500) comprising bristles (510) located on the stationary disk first side (210).

In some embodiments, the system (100) comprises a cartridge (600) having a tapered cartridge first end (610) comprising a cartridge opening (612) and a cartridge membrane (614) that can be ruptured on a cartridge tip (616), a generally flat cartridge second end (620), a generally cylindrical cartridge body (630), and a cartridge hollow cavity (640) located inside. In some embodiments, the cartridge (600) comprises a pressure means (650) to dispose a load of shaving cream (110) from the cartridge (600) through the cartridge membrane (614) through the cartridge opening (612). In some embodiments, the cartridge (600) resembles a bullet.

In some embodiments, the stationary disk (200) comprises a stationary disk channel (240) fluidly connected to an aperture on the stationary disk second side (220). In some embodiments, the stationary disk channel (240) traverses the cross-section of the stationary disk (200). In some embodiments, the stationary disk channel (240) fluidly connects to an aperture on the stationary disk first side (210). In some embodiments, the stationary disk channel (240) comprises a stationary disk tubing extension (250) that fluidly connects to the aperture on the stationary disk first side (210). In some embodiments, the stationary disk tubing extension (250) projects out and away from the stationary disk first side (210) into the brush head (500). In some embodiments, the stationary disk channel (240) comprises an o-ring seal (260) on the stationary disk second side (220). In some embodiments, the cartridge tip (616) interfaces against and seals against the o-ring seal (260) on the stationary disk second side (220). In some embodiments, shaving cream (110) is transported from the cartridge hollow cavity (640) through the cartridge opening (612), through the stationary disk channel (240), through the stationary disk tubing extension (250), into the brush head (500) for use by the user.

In some embodiments, a fastening rod (700) is located through the central cross-section of the stationary cover (400), the brush body (300), and the stationary disk (200).

In some embodiments, the stationary disk (200) comprises finger gripping recesses (710) on an outside surface.

In some embodiments, the brush body (300) has finger gripping recesses (710) on an outside surface.

In some embodiments, the pressure means (650) comprises a cartridge rotating cap (652), a cartridge rotating disk (654), and a cartridge threaded shaft (656). In some embodiments, when the cartridge rotating disk (654) is rotated via the cartridge rotating cap (652), shaving cream (110) is transported from the cartridge hollow cavity (640) through the cartridge opening (612), through the stationary disk channel (240), through the stationary disk tubing extension (250), into the brush head (500) for use by the user. In some embodiments, a gasket (674) facilitates a seal.

In some embodiments, the pressure means (650) comprises a cartridge pump head (662), a cartridge check valve (664), a cartridge spring (666), and a cartridge dip tube (668). In some embodiments, when the cartridge pump head (662) is actuated, shaving cream (110) is transported from the cartridge hollow cavity (640) through the cartridge dip tube (668), through the cartridge opening (612), through the stationary disk channel (240), through the stationary disk tubing extension (250), into the brush head (500) for use by the user. In some embodiments, a gasket (674) facilitates a seal.

In some embodiments, the pressure means (650) comprises a cartridge actuator (672), a cartridge spring (666), and a cartridge dip tube (668). In some embodiments, when the cartridge actuator (672) is actuated, shaving cream (110) is transported from the cartridge hollow cavity (640) through the cartridge dip tube (668), through the cartridge opening (612), through the stationary disk channel (240), through the stationary disk tubing extension (250), into the brush head (500) for use by the user. In some embodiments, a gasket (674) facilitates a seal. In some embodiments, the brush body second end (320) comprises a cartridge slot (340) sized to represent a standard bullet size. In some embodiments, standard bullet sizes include the following (in caliber): .17, .177, .20, .204, .22, .218, .219, .220, .221, .222, .223, .224, .225, .226, .228, .24, .25, .257, .26, .27, .28, .30, .32, .325, .327, .338, .35, .357, .38, .40, .404, .405, .408, .41, .416, .43, .44, .45, .454, .458, .46, .475, .480, .50, .57, .68, .79, and .95. In some embodiments, the brush body second end (320) comprises a cartridge slot (340) sized to not represent a standard bullet size.

In some embodiments, the stationary disk (200) is connected to the stationary cover (400) by stationary support member (720) that traverses over, without contacting the brush body (300).

As used herein, the term "about" refers to plus or minus 10% of the referenced number. For example, an embodiment wherein the brush body is about 10 inches in length includes a brush body that is between 9 and 11 inches in length. The disclosures of the following U.S. Patents are incorporated in their entirety by reference herein: U.S. Pat. No. D587,778; U.S. Pat No. D564,232; U.S. Pat. No. D307,216; U.S. Pat. Pub. No. 2011/0142530 A1; U.S. Pat. No. 7,695,207; U.S. Pat. No. 6,003,523.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A shaving cream applicator brush system (100) using replaceable cartridges (600) having a general form of a bullet for applying shaving cream (110) through a brush head (500) to a user for shaving, said system (100) comprising:

(a) a stationary disk (200) having a stationary disk first side (210), a stationary disk second side (220), and a stationary disk central axis (230) disposed through a central cross-section;

(b) a brush body (300) disposed on the stationary disk second side (220), having a brush body first end (310), a brush body second end (320), and a brush body central axis (330) disposed through a central cross-section from the brush body first end (310) to the brush body second end (320), wherein the brush body central axis (330) is disposed on the stationary disk central axis (230), wherein the brush body (300) is rotatable with respect to the brush body central axis (330), wherein the brush body second end (320) comprises a plurality of radially disposed cartridge slots (340) with respect to the brush body central axis (330);

(c) a radially tapered stationary cover (400) disposed on the brush body second end (320), having a stationary cover first end (410), a stationary cover second end (420), and a stationary cover central axis (430) disposed through a central cross-section, wherein the stationary cover central axis (430) is disposed on the stationary disk central axis (230), wherein the stationary cover (400) further comprises a loading recess (440) with loading cap (450), wherein the loading recess (440) provides access to the cartridge slot (340);

(d) a brush head (500) comprising bristles (510) disposed on the stationary disk first side (210); and (e) a cartridge (600) having a radially tapered cartridge first end (610) comprising a cartridge opening (612) and a rupturable cartridge membrane (614) on a cartridge tip (616), a generally flat cartridge second end (620), a generally cylindrical cartridge body (630), and a cartridge hollow cavity (640) disposed therein, wherein the cartridge (600) comprises a pressure means (650) to dispose a load of shaving cream (110) from the cartridge (600) via the cartridge membrane (614) via the cartridge opening (612);

wherein the stationary disk (200) comprises a stationary disk channel (240) fluidly connected to an aperture on the stationary disk second side (220), wherein the stationary disk channel (240) traverses the cross-section of the stationary disk (200), wherein the stationary disk channel (240) fluidly connects to an aperture on the stationary disk first side (210), wherein the stationary disk channel (240) comprises a stationary disk tubing extension (250) that fluidly connects to the aperture on the stationary disk first side (210), wherein the stationary disk tubing extension (250) projects out and away from the stationary disk first side (210) into the brush head (500), wherein the stationary disk channel (240) comprises an o-ring seal (260) on the stationary disk second side (220), wherein the cartridge tip (616) interfacably seals against the o-ring seal (260) on the stationary disk second side (220), wherein shaving cream (110) is adapted to be transported from the cartridge hollow cavity (640) via the cartridge opening (612), via the stationary disk channel (240), via the stationary disk tubing extension (250), into the brush head (500) for use by the user;

wherein a fastening rod (700) is disposed through the central cross-section of the stationary cover (400), the brush body (300), and the stationary disk (200).

2. The system (100) of claim 1, wherein the stationary disk (200) comprises finger gripping recesses (710) on an outside surface.

3. The system (100) of claim 1, wherein the brush body (300) has finger gripping recesses (710) on an outside surface.

4. The system (100) of claim 1, wherein the pressure means (650) comprises a cartridge rotating cap (652), a cartridge rotating disk (654), and a cartridge threaded shaft (656), wherein when the cartridge rotating disk (654) is rotated via the cartridge rotating cap (652), shaving cream (110) is adapted to be transported from the cartridge hollow cavity (640) via the cartridge opening (612), via the stationary disk channel (240), via the stationary disk tubing extension (250), into the brush head (500) for use by the user.

5. The system (100) of claim 1, wherein the pressure means (650) comprises a cartridge pump head (662), a cartridge check valve (664), a cartridge spring (666), and a cartridge dip tube (668), wherein when the cartridge pump head (662) is actuated, shaving cream (110) is adapted to be transported from the cartridge hollow cavity (640) via the cartridge dip tube (668), via the cartridge opening (612), via the stationary disk channel (240), via the stationary disk tubing extension (250), into the brush head (500) for use by the user.

6. The system (100) of claim 1, wherein the pressure means (650) comprises a cartridge actuator (672), a cartridge spring (666), and a cartridge dip tube (668), wherein when the cartridge actuator (672) is actuated, shaving cream (110) is adapted to be transported from the cartridge hollow cavity (640) via the cartridge dip tube (668), via the cartridge opening (612), via the stationary disk channel (240), via the stationary disk tubing extension (250), into the brush head (500) for use by the user.

7. The system (100) of claim 1, wherein the brush body second end (320) comprises a cartridge slot (340) sized to represent a standard bullet size.

* * * * *